US005253617A

United States Patent [19]

Fitzpatrick et al.

[11] Patent Number: 5,253,617

[45] Date of Patent: Oct. 19, 1993

[54] REED VALVE ASSEMBLY FOR AN INTAKE MANIFOLD AND METHOD OF ASSEMBLY

[75] Inventors: Richard E. Fitzpatrick, Schaumburg; William K. McDannel, Darien; Craig R. Leitner, St. Charles, all of Ill.

[73] Assignee: Capsonic Group Inc., Elgin, Ill.

[21] Appl. No.: 940,074

[22] Filed: Sep. 3, 1992

[51] Int. Cl.[5] ..... F02M 35/00

[52] U.S. Cl. ..... 123/52 MF; 137/856

[58] Field of Search ..... 123/52 MF, 73 V; 137/512.15, 855, 856

[56] References Cited

U.S. PATENT DOCUMENTS

| | | | |
|---|---|---|---|
| 1,672,436 | 6/1928 | Thege | 137/856 |
| 4,422,416 | 12/1983 | Bernardoni | 123/52 MF |
| 4,955,329 | 9/1990 | D'Angelo et al. | 123/52 MF |
| 5,018,486 | 5/1991 | Davis et al. | 123/52 MF |
| 5,027,754 | 7/1991 | Morone | 123/52 MF |
| 5,103,867 | 4/1992 | Wu | 123/52 MF |

FOREIGN PATENT DOCUMENTS

| | | | |
|---|---|---|---|
| 3328584 | 2/1984 | Fed. Rep. of Germany | 123/52 MF |

*Primary Examiner*—E. Rollins Cross
*Assistant Examiner*—M. Macy
*Attorney, Agent, or Firm*—Trexler, Bushnell, Giangiorgi & Blackstone, Ltd.

[57] ABSTRACT

A valve assembly is provided for location in a fluid flow path between an intake manifold and a cylinder for preventing blow back from the cylinder into the manifold and for reducing back pressure in said manifold on an internal combustion engine. The assembly comprises a plurality of valved units each having an inlet and an outlet. The inlet is operatively connected to the intake manifold, and the outlet is operatively connected to the cylinder. A valve member is disposed on each of the units and is flexible between a valve open position where the member is offset from the outlet, and a valve closed position where the member operatively closes the outlet, thereby preventing reversed fluid flow from the cylinder into the intake manifold. A novel method of assembling the reed valve assembly of the present invention is also provided. This method comprises the steps of molding a main body comprising an inlet and an outlet from a plastic material, and insert molding a valve petal member in the main body for opening and closing the outlet. A further step includes overmolding a cushioning surface adjacent the outlet against which the petal member engages and seals for closing the outlet.

19 Claims, 4 Drawing Sheets

Fig. 1
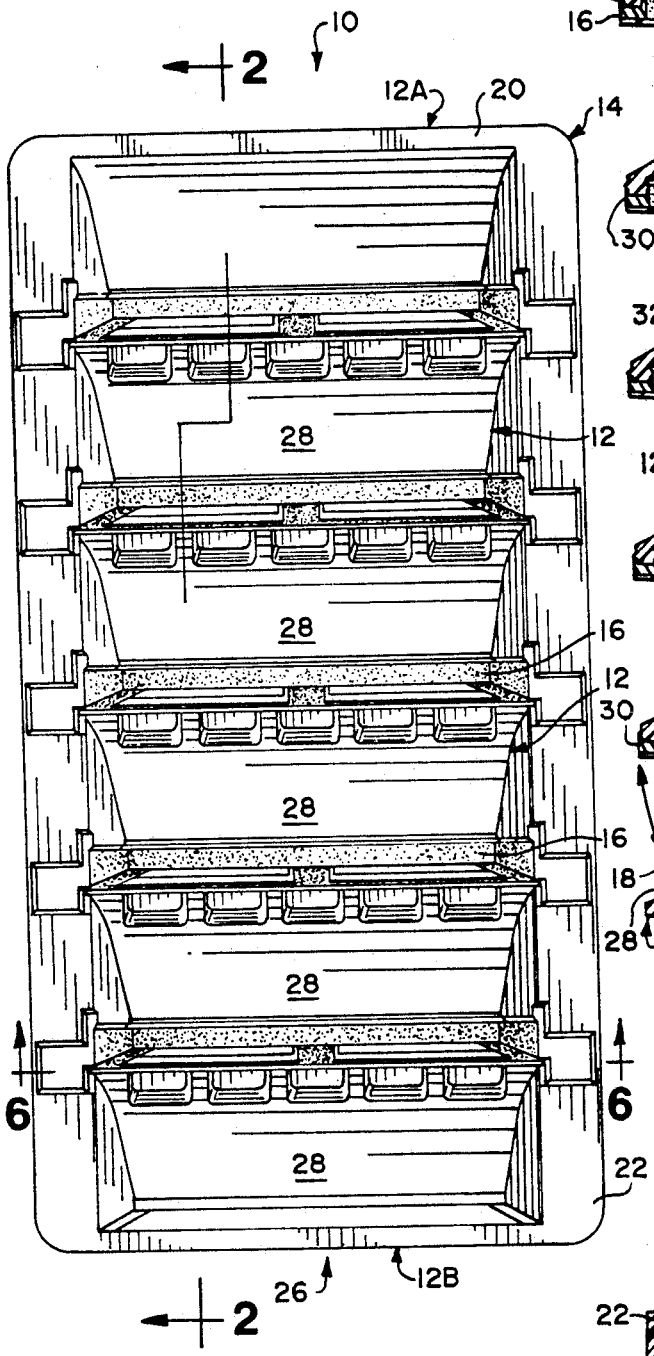
Fig. 2
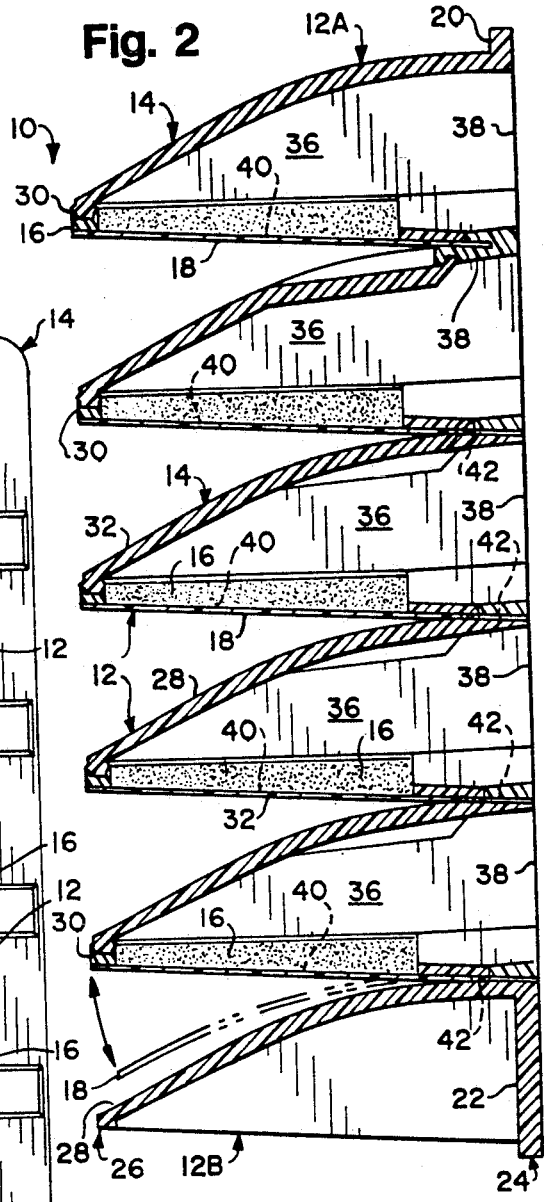
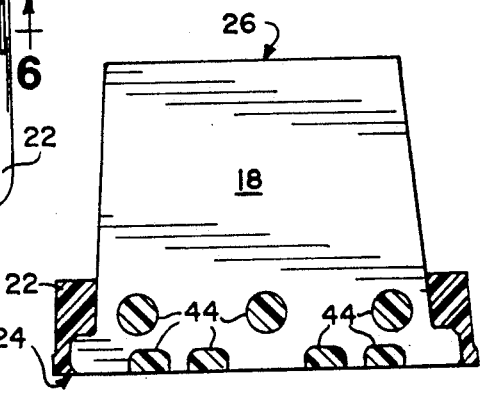
Fig. 6

REED VALVE ASSEMBLY FOR AN INTAKE MANIFOLD AND METHOD OF ASSEMBLY

BACKGROUND AND SUMMARY OF THE INVENTION

The present invention relates generally to an apparatus for reducing or eliminating blow back into an intake manifold in an internal combustion engine and a method of assembling said apparatus. More specifically, the invention relates to a novelly constructed reed valve assembly for preventing engine efficiency-robbing turbulence from forming in a manifold in an internal combustion engine.

The construction and operation of internal combustion engines are well known in the relevant art. During the cyclic operation of such an engine, a mixture of air and fuel is delivered from an intake manifold to a cylinder, having an oscillating piston, through an intake valve for combustion. The intake valve is located in the air/fuel mixture flow path between the manifold and the cylinder.

At the beginning of the engine's cycle in it's simplest form, the piston is located adjacent a top of the cylinder. The intake valve is opened, and the piston begins its downward stroke within the cylinder. The downward movement of the piston generates a reduced or negative pressure in the cylinder. Simultaneously, a mixture of air and fuel is injected, under an increased or positive pressure, into the intake manifold. The pressure differential between the intake manifold and the cylinder causes the air/fuel mixture to move, or be sucked into the cylinder. Once the piston reaches the bottom of the cylinder, the piston reverses its travel and begins its upward stroke towards the top of the cylinder (i.e. the compression stroke). The intake valve is simultaneously closed, and the air/fuel mixture is compressed between the top of the cylinder and the advancing piston. Once the piston reaches the top of the cylinder, the air/fuel mixture is ignited, and the combustion of the mixture drives the piston downwards, thereby generating power in the engine. Now, the exhaust stroke of the piston begins, wherein the exhaust valve opens and the piston moves upwardly to force the exhaust gases from the cylinder out through the exhaust valve. Upon completion of the exhaust stroke, the piston is in position to repeat the cycle.

In theory, internal combustion engines are to function in generally the above-discussed fashion. However, in practice, this does not always occur precisely as intended as a back pressure may be generated in the intake manifold which can cause turbulence in the intake manifold, and which can compromise the efficiency of the engine, especially since multiple cylinders are often associated with a single manifold. In practice, engine behavior during normal operation, at all speeds within normal operating ranges, is precisely controlled by mechanical, electrical, and fluid dynamic means. It is common practice to adjust intake and exhaust valve timing such that at higher engine speeds the momentum of the exiting exhaust gases can be taken advantage of. This momentum is utilized to provide a scavenging effect to the cylinder while dynamically drawing in additional air/fuel charge. To accomplish this, engine/cam/induction/exhaust system designers open the intake valve prior to the piston reaching top dead center. At this point the exhaust valve is also slightly open. This situation is commonly referred to as overlap, a point at which the exhaust valve lift curve overlaps the intake valve lift curve, that is, both valves are in the open position. At higher engine speeds (those which produce sufficient exhaust gas momentum) the high speed exhaust charge traveling down the manifold will produce a negative pressure in the cylinder. This draws the intake charge into the cylinder even though at the beginning of this scavenging and charging the piston is still moving up. Note that due to the harmonic motion generated by the slider crank mechanism which attaches the piston to the crank shaft, that piston velocity is approaching 0.0 at this point. Engine designs can be optimized to take advantage of this effect to produce additional power in the desired RPM range due to the resulting denser intake charge. This approach is known to produce additional power within a defined engine speed range. However, at lower engine speeds exhaust gas velocity is insufficient to produce the desired effect. Under these circumstances, exhaust gases are forced back into the intake system causing turbulance and disturbing charge density, a condition commonly referred to as "blow back." The result is reduced power at lower engine speeds and rough idle. The reed valve assembly of the present invention is beneficial in reducing the blow back and turbulance mentioned above. With a reed valve device in the system, one can achieve the benefits of cylinder scavenging at higher engine speeds without the performance sacrifice at lower engine speeds and rough idle.

It is known to employ a reed valve assembly in the intake manifold of an internal combustion engine to prevent "blow-back" or turbulence in the manifold. The present invention provides an improved reed valve construction as well as a method of assembling the improved reed valve.

OBJECTS AND SUMMARY OF THE INVENTION

A general object of the present invention is to provide a novelly constructed reed valve assembly for an intake manifold in an internal combustion engine.

A more specific object of the invention is to provide a reed valve assembly which can minimize or eliminate blow back of gases into an intake manifold in an internal combustion engine.

Another object of the present invention is to provide a reed valve assembly which can assist in increasing efficiency of air/fuel mixture delivery to cylinders in an internal combustion engine.

An additional object of the invention is to provide a reed valve assembly which can reduce or eliminate fluid turbulence in an intake manifold in an internal combustion engine.

A further object of the present invention is to provide a novel method of assembling a reed valve for employment in an internal combustion engine.

A reed valve assembly, constructed according to the teachings of the present invention, is provided for location in a fluid flow path between an intake manifold and a cylinder for preventing blow back from the cylinder into the manifold and for reducing back pressure in said manifold on an internal combustion engine. The assembly comprises a plurality of molded valved unit bodies each having an inlet and an outlet. The inlet is operatively connected to the intake manifold, and the outlet is operatively connected to the cylinder. A valve petal member is disposed on each of the units and is insert molded and designed to flex between a valve open position where the member is offset from the outlet, and a valve closed position where the member operatively closes the outlet, thereby preventing reversed fluid flow from the cylinder into the intake manifold. In addition, the molded valved body unit includes an elastomeric cushioning surface adjacent the outlet of the valved body against which its valve petal engages and seals.

A novel method of assembling the reed valve assembly of the present invention is also provided. This method comprises the steps of molding a main body comprising an inlet and an outlet from a plastic material, and insert molding a valve petal member in the main body for opening and closing the outlet. A further step includes overmolding a cushioning surface adjacent the outlet against which the petal member engages and seals for closing the outlet.

BRIEF DESCRIPTION OF THE DRAWINGS

The organization and manner of the structure and operation of the invention, together with further objects and advantages thereof, may best be understood by reference to the following description taken in connection with the accompanying drawings, wherein like reference numerals identify like elements in which:

FIG. 1 is a front elevational view of a reed valve assembly, constructed according to the teachings of the present invention, for an intake manifold on an internal combustion engine;

FIG. 2 is a sectional view, taken along line 2—2 of FIG. 1, showing the unique construction of the assembly with one of the reeds shown in an open position in phantom;

FIG. 6 is a sectional view, taken along line 6—6 of FIG. 1, of the assembly;

DETAILED DESCRIPTION OF PREFERRED EMBODIMENTS

Figure 3:
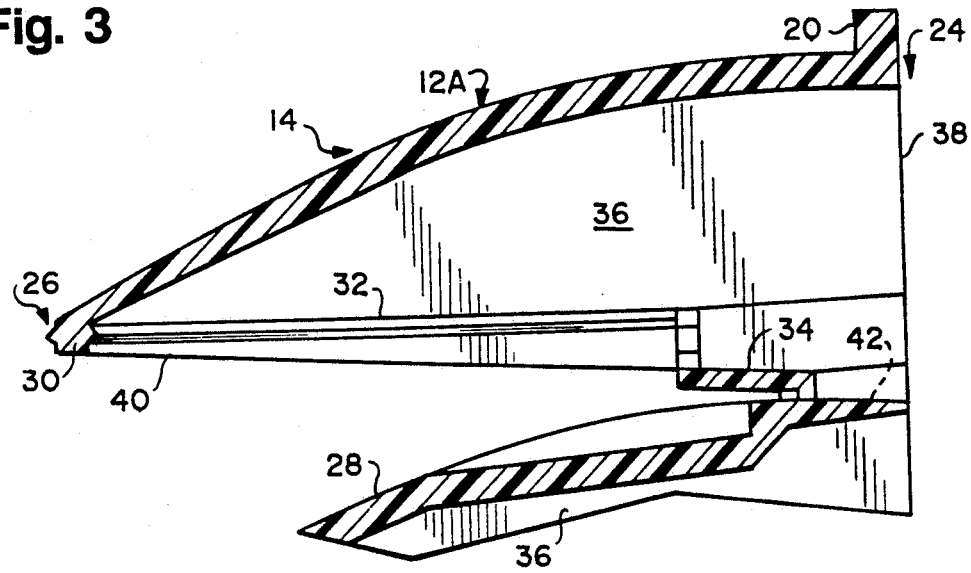
FIG. 3 is a partial sectional view of a portion of a frame or main body comprising the assembly.
Figure 4:
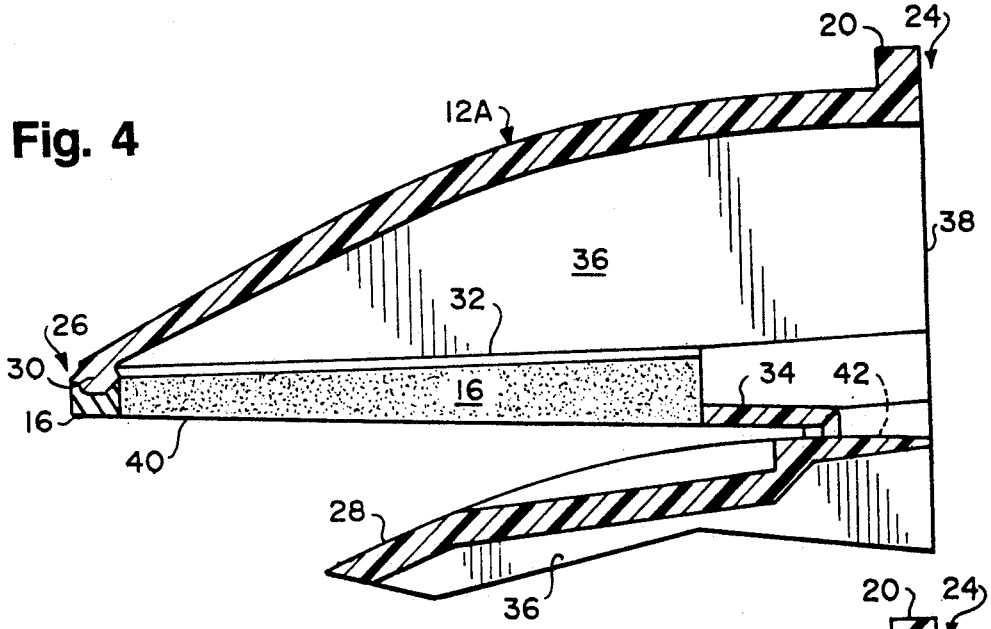
FIG. 4 is a partial sectional view of the portion of the frame of FIG. 3 having an elastomeric cushion overmolded thereon.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Referring initially to FIGS. 1 and 2, a reed valve assembly 10, constructed according to the teachings of the present invention, for an intake manifold in an internal combustion engine is shown. The assembly 10 comprises a plurality of valved units 12, preferably five in number, for association with each cylinder in the internal combustion engine. Each of the valved units 12 generally comprises a frame or main body 14, an elastomeric cushion or gasket 16 overmolded onto the main body 14, and a flexible, substantially planar reed petal member 18 inserted into the body 14 and secured thereto by another overmold of plastic.

The main body 14, preferably comprised of the five units 12, is molded as a single piece from a suitable material, preferably nylon. The particular structure of the body 14 is illustrated clearly in FIGS. 2 and 3. Specifically, the body 14 includes a top planar portion 20 (as viewed in the drawings) and a bottom planar portion 22 which facilitate mounting of the assembly 10 in an intake manifold, not shown. It should be noted that the disposition of the assembly 10 in a manifold will vary from the positioning shown in the drawings, as such, use of terms such as "top" and "bottom" relate to the drawings and are adopted for purposes of description only. The body 14 also has an intake end 24, illustrated clearly in FIGS. 2 through 5, and an outlet end 26. The assembly 10 is mounted in the intake manifold in the air/fuel mixture flow path between an intake valve of a cylinder and an air/fuel mixture source, all not shown for clarity, so that the intake end 24 opposes the source and the outlet end 26 opposes the intake valve. Accordingly, there are preferably five units 12 associated with each cylinder in the engine.

As shown in FIG. 2, each of the units 12 are identically constructed except for the unit 12A, immediately adjacent the portion 20, and the unit 12B, immediately adjacent the portion 22, as will be discussed further hereinbelow. The units 12, 12A and 12B are configured to operatively support the reeds 18, which flex between a valve closed and a valve open position, shown in FIG. 5. Specifically, the units 12, 12A and 12B comprise a convexly curved upper reed support 28 defining an upper surface of the units 12. The support 28 of one unit 12 is intended to support the reed 18 of an upwardly adjacent unit 12, when that reed 18 is in the valve open position, shown at the unit 12 at the bottom, as viewed, of FIG. 2, and in FIG. 5.

The reed supports 28 extend in a downwardly curved fashion from the intake end 24 towards the outlet end 26. An end of the supports 28 opposite to the ends thereof defined by the intake end 24 are defined by a rim 30 which extends substantially around a periphery of the units 12 approaching the outlet end 26. The rim 30, visible in FIGS. 2 through 5, is configured to accept and to support the cushion 16, which is overmolded onto the main body 14, as will be discussed further later. Supporting members 32 extend in substantially linear fashion from the rim 30 rearwardly to a substantially "L" shaped base portion 34 adjacent the intake end 24. The base portions 34 of the units 12, 12A define integral junctures between adjacent units 12, 12A. Together, the support 28, the members 32, and the base portion 34 define a volume chamber 36 within each unit 12, 12A for accepting an air/fuel mixture from the intake manifold and delivering said mixture to the cylinder associated with the assembly 10.

Figure 7:
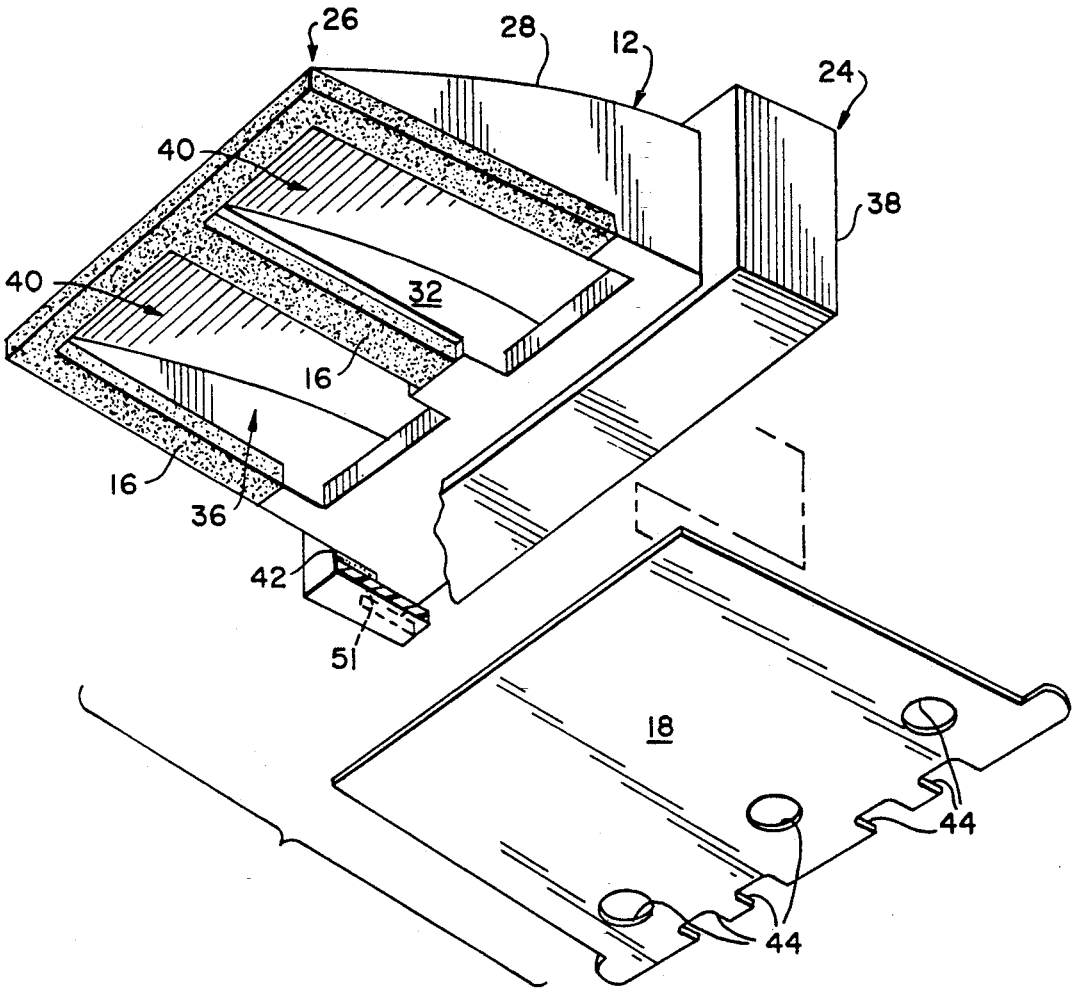
FIG. 7 is a generic exploded perspective view of a portion of the assembly, prior to overmolding of the reed valve member, with a portion broken away to illustrate reed insertion into a slot.

The volume chamber 36 has an inlet 38, shown in FIGS. 2 through 5, for allowing the air/fuel mixture to enter the chamber 36 formed between the end of the reed support 28 and the end of the portion 34 adjacent the intake end 24. As shown in FIG. 7, the rim 30 and the support members 32 cooperate with the cushion 16 to form a chamber outlet 40 for allowing the mixture to leave the chamber 36 and proceed to the cylinder. In some embodiments, like that shown in FIG. 7, the elastomeric cushion 16 can be overmolded onto the support members 32 as well as onto the rim 30. The reed 18 is capable of closing the outlet 40 in the valve closed position, thereby preventing blow back into the intake manifold, as will be discussed further hereinafter.

A slot 42 is provided with each unit 12 for slidably accepting the reed petal member 18. The reed 18 itself is constructed from a suitable composite plastic material which can withstand heat and flexing at the high rates of speed discussed above. The composite material also has inherent resiliency to assist the reed 18 in flexing back towards the valve closed position from the valve open position. The reed 18 is dimensioned for covering the outlet 40. The reed 18 also has a plurality of holes 44 therein, shown in FIG. 6, for accepting an overmolded plastic material, such as nylon, for fixing the reed 18 to the units 12 at one end. Because the reed 18 is fixed only at one end, flexing of the reed 18 between the valve open and the valve closed positions is thereby facilitated. However, it is to be noted that the flexing of the reed 18 into the valve open position is limited by contact with the support 28.

The slot 42 is located adjacent a bottom portion of the base 34 in each unit 12, 12A and 12B so that, when the reed 18 is inserted therein from the intake end 24 of the main body 14, the reed 18 will confront and engage the cushion 16 below the rim 30 and the supporting members 32. Thus, the reed 18 is able to effectively close the outlet 40 and effectively seal that portion of the volume chamber 36 when in the valve closed position. This effective sealing of the chamber 36 need only be sufficiently effective to prevent blow back into the manifold. Also, because of the high rate of speed of flexing of the reed 18, the cushion 16 assists in absorbing forces attendant with the impact of the reed 18 with the body 14 when shifted into the valve closed position.

As noted above, the structure of the units 12A and 12B differs from the units 12. Specifically, as shown in FIGS. 2 through 5, the unit 12A differs from the units 12 in that the unit 12A includes the top planar portion 20 projecting from an end of the reed support 28 thereof adjacent the intake end 24. Also, the reed support 28 of the unit 12A will not support a reed 18 in the illustrated embodiment.

The unit 12B, shown at the bottom, as viewed, of FIG. 2, differs in construction from the units 12 and the unit 12A in that the unit 12B includes the bottom planar portion 22 depending from an end of the base portion 34 adjacent the intake end 24. Also, a reed support 28 projects from the juncture between the portion 22 and the base 34 for supporting the reed 18 associated with the unit 12B in the valve open position. The portion 22 and the reed support 28 for the unit 12B define a chamber 44. However, the chamber 44 does not have an intended function as the chambers 36 do.

With the structure of the assembly 10 being thusly disclosed, the novel method of assembly or construction thereof will now be discussed in detail. It is to be carefully noted that additional structural limitations and requirements of the assembly 10 may become apparent with reference to the following discussion.

To begin construction of the assembly, the main body 14 is molded from a suitable plastic material, such as nylon. In the preferred embodiment illustrated in FIGS. 1 through 7, five valved units 12, 12A and 12B are integrally formed on the assembly 10. At this point, the assembly 10, and particularly the unit 12A, appear as shown in FIG. 3. Basically, a skeletal structure or frame for the assembly 10 has been created.

In the next step, the elastomeric cushion 16 is overmolded onto the rim 30 and the support members 32 of each unit 12, 12A and 12B. It is to be noted that the overmolding of the cushion 16 onto the rim 30 may be eliminated without departing from the scope of the invention. Also, as noted hereinabove, the cushion 16 may also be overmolded onto other portions of the units 12, 12A and 12B. The particular configuration of the rim 30 insures that the cushion 16 will be retained thereon. This elastomeric overmold is shown in FIGS. 2, 4, 5, and 7. The units 12, 12A and 12B are ready to slidably accept their respective reeds 18.

The reed petal members 18 are applied to each of the units 12, 12A and 12B by sliding the reeds 18 through the slots 42 from the intake end 24 towards the outlet end 26, as illustrated in FIG. 7. Individual reeds 18 are slid into each of the slots 42 such that distal ends thereof abut outer edges of the cushion 16 on the rims 30. A positive stop member 51, shown in FIG. 7, may be included with the units 12, 12A and 12B for positively locating the reeds 18 in proper positions with respect to the units 12, 12A and 12B. Proper positioning of the reeds 18 through the slots 42 allows the reeds 18 to cover the outlet 40 of the respective volume chamber 36. The reeds 18 are properly positioned when back ends thereof are aligned flush with the intake end 24 of the main body 14, as shown in FIG. 6. In this position, each of the reeds 18 contact the cushions 16 on the rims 30 and the supporting members 32, thereby defining the valve closed position.

Figure 5:
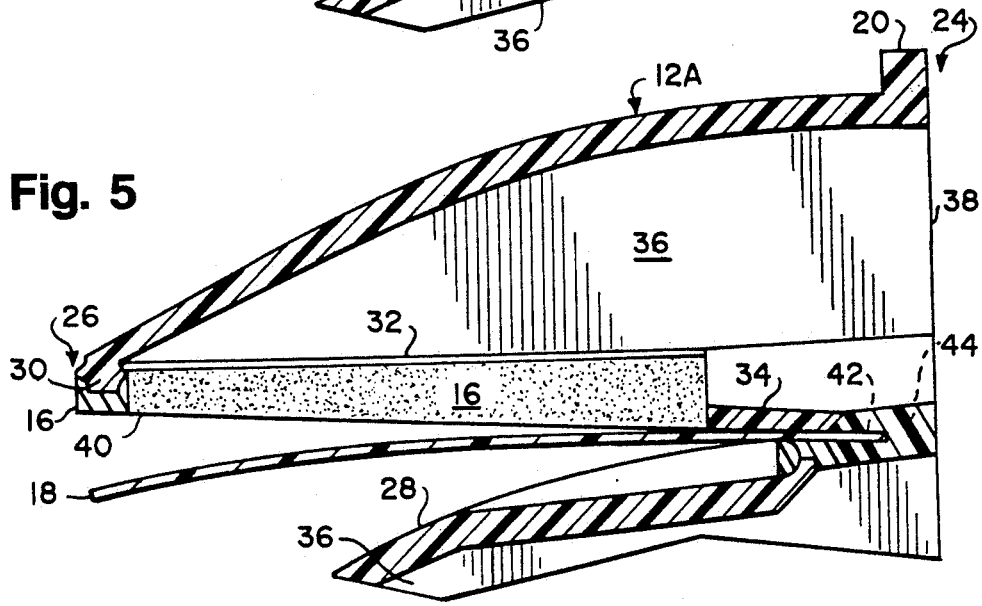
FIG. 5 is a partial sectional view of the portion of the frame of FIG. 4 having a reed valve member, shown in an open position, inserted therein and overmolded to form a portion of the assembly.

The final step of the construction process secures the reeds 18 to the individual valved units 12, 12A and 12B. Specifically, another overmold operation takes place. A plastic material, again preferably nylon, is overmolded surrounding the juncture between units 12, 12A and 12B and the reeds 18, as shown in FIGS. 2, 5, and 6. This juncture is only adjacent and along the intake end 24 (recall the reeds 18 contact the cushions 16 at all other locations of contact). The holes 44 in the reeds 18 accept this second overmolded material, thereby firmly binding the reeds 18 to the units 12, 12A and 12B at the intake end 24, as shown in FIG. 6. Because the reeds 18 are fixedly mounted only at this one end, the opposite ends thereof are free to shift or flex into an out of engagement with the cushions 16, corresponding to the valve closed and valve open positions. The assembly 10 is now complete, and is ready for installation into an internal combustion engine at a location in the air/fuel mixture flow path between the intake manifold and the intake valve of a particular cylinder.

Once the assembly 10 is properly installed, the assembly 10 functions in the following manner. When a piston begins its intake down stroke, an air/fuel mixture is supplied to the intake manifold under pressure. The reeds 18 are initially in the valve closed position, thereby closing the outlet 40. Positive pressure on the side of the reeds 18 opposite to the sides thereof contacting the rims 30 and the supporting members 32 holds the reeds 18 in the valve closed position. The pressurized mixture enters the volume chambers 36 of the assembly 10 through the inlet 38 and stops upon confrontation with the reeds 18.

As the piston shifts downwardly within the cylinder, a negative pressure or vacuum is formed in the cylinder above the shifting piston and on a side of the reeds 18 opposite to the sides thereof sealing the volume chambers 36. This negative pressure increases as the piston shifts downwardly within the cylinder. A pressure differential is formed by the negative pressure on the outlet side of the reeds 18 and the positive pressure on the inlet side thereof. The pressure differential causes the reeds 18 to flex out of contact with the cushions 16 and into the valve open position, illustrated at the bottom most unit 12, as viewed, in FIG. 2. Once the reeds 18 are in the valve open position, the mixture in the volume chambers 36, and the intake manifold for that matter, flows into the cylinder across the intake valve. This occurs until the pressure differential is eliminated. At this point, the natural resiliency of the composite material comprising the reeds 18 flexes the reeds 18 back towards the valve closed position.

Once the piston reaches the bottom of its stroke, the piston begins its compression stroke. As the piston moves or shifts upwardly, the piston creates a blow back or back pressure directed towards the assembly 10 and the intake manifold. This back pressure is accentuated if the intake valve associated with the particular cylinder does not close on time as intended. If this back pressure reaches the intake manifold, turbulence can be created, thereby compromising efficiency of the engine.

However, due to the presence of the assembly 10 in the fluid flow path between the cylinder and the intake manifold, the back pressure is prevented from reaching the intake manifold, and no turbulence is formed therein. Specifically, the back pressure propagates back along the path of air/fuel mixture travel from the cylinder towards the assembly 10. The back pressure encounters the outlet sides of the reeds 18, thereby forcing the reeds 18 to flex into the valve closed position and contact the cushions 16. The reeds 18 shift until the inlet sides thereof contact the associated cushions 16 disposed on the rims 30 and the supporting members 32, thereby preventing the back pressure from entering the volume chambers 36 and, more importantly, the intake manifold.

The cushions 16 serve to cushion the impact between the reeds 18 and the rims 30 and the supporting members 32, which is especially important upon considering the fact that the reeds 18 must flex between the valve open and valve closed positions approximately seven hundred to three thousand five hundred times each minute. The cushions 16 may also provide a sealing effect between the reeds 18 and the units 12, 12A and 12B, thereby further insuring that the back pressure does not enter the intake manifold. In this manner, the efficiency of the engine is preserved.

Figure 8:
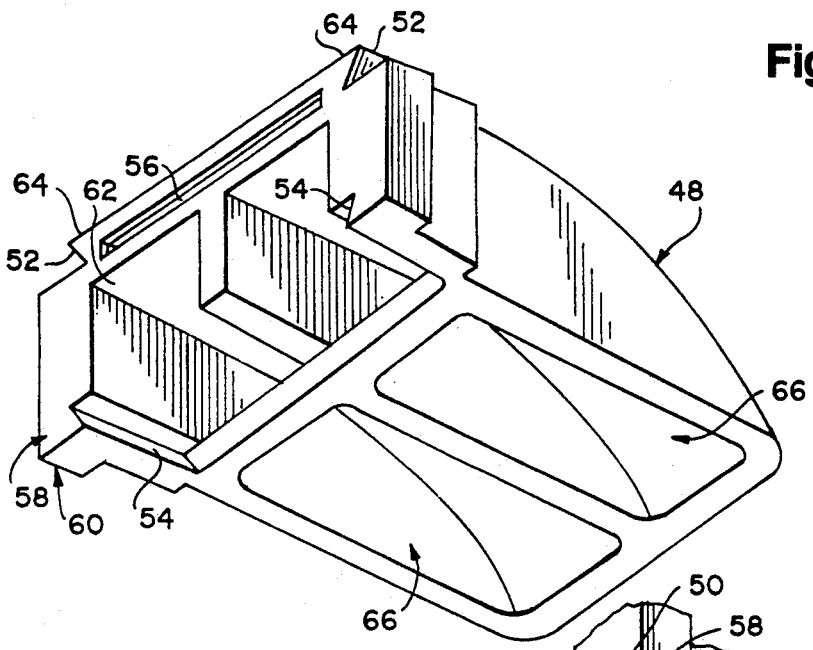
FIG. 8 is a perspective view of another embodiment of the present invention comprising a modular unit for constructing a valve assembly.
Figure 9:
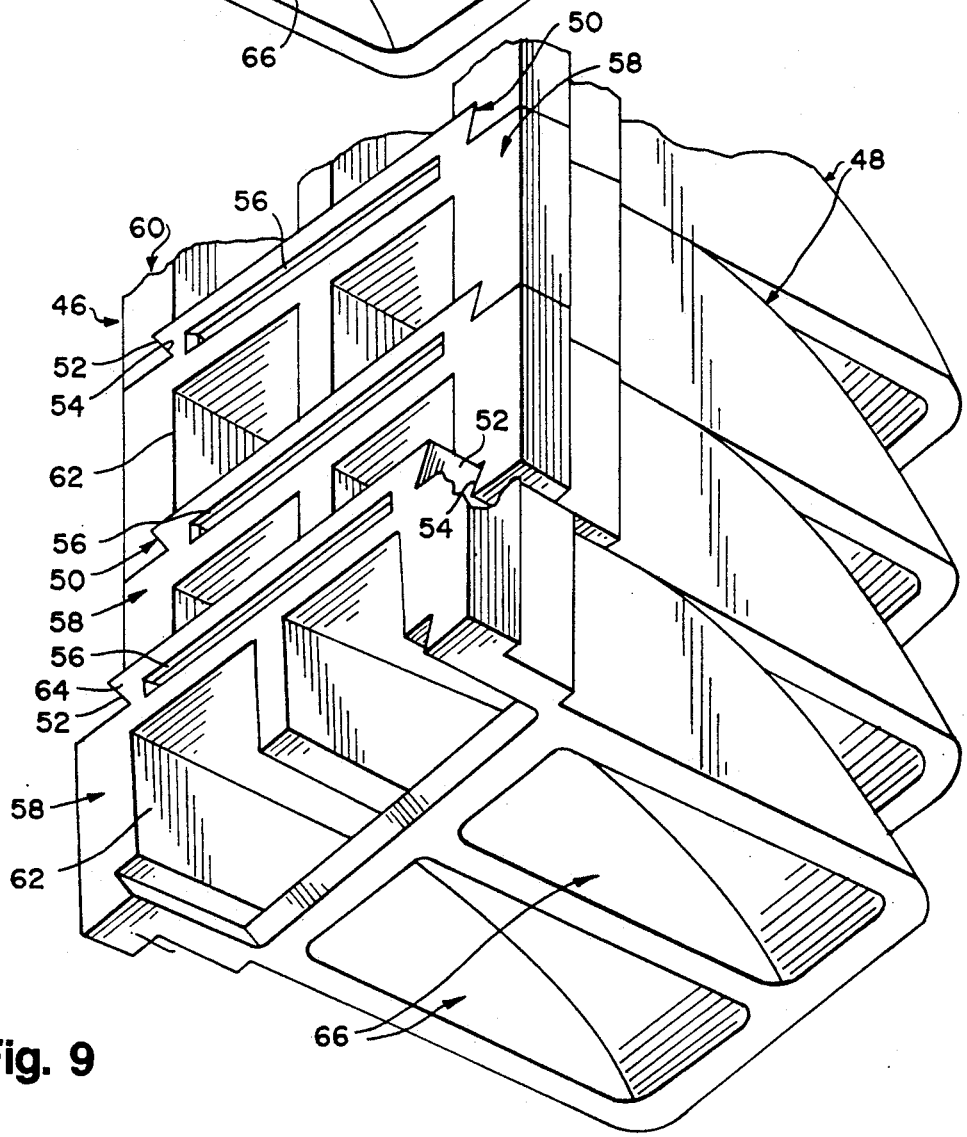
FIG. 9 is a perspective view of a plurality of modular units of FIG. 8 comprising a valve assembly, illustrating the construction thereof from the individual modules.

An alternative embodiment, a valve assembly 46, of the present invention is illustrated in FIGS. 8 and 9. The valve assembly 46 is constructed and functions substantially similarly to the assembly 10. Accordingly, the structure of the assembly 46 will be discussed in detail with respect to only those portions thereof which are different from the assembly 10.

The assembly 46, shown in FIG. 9, comprises a plurality of interlockable, identically constructed units 48, illustrated in FIG. 8, substantially similar to the units 12. The characteristics of the units 48 distinguishing from the units 12 amount to interlocking means 50, in the form of a dovetail 52 and a complementary notch 54, and a slot 56 for accepting the reed 18 located on the dovetail 52. In this manner, any desired number of units 48 can be slidably joined together to form the assembly 46. The method of assembling the units 48 is substantially similar to the above-described method with the additional step of molding interlocking means 50 onto the units 48.

The unit 48, as shown in FIG. 8, has a substantially planar base portion 58 defining an intake end 60 and an inlet 62 of the unit 48. The portion 58 defines the height of the unit 48. The dovetail 52 projects substantially perpendicularly upwards from the top of the portion 58 along a substantial portion of the width of the base 58. The dovetail 52 includes a flared portion 64 for engaging the notch 54 of an adjacent unit 48. The slot 56 is disposed through the base portion 58 between the dovetail 52 and the inlet 62. The slot 56 also slidably accepts the reed 18 as the slot 42 does, however, the slot 56 of one unit 48 holds the reed 18 for closing an outlet 66 of another unit 48, joined to the one unit 48 at the dovetail 52 of the one unit 48. This structure is shown in FIG. 9.

The notch 54 is located along a portion of the base 58 opposite to the dovetail 52. The notch 54 also extends along the width of the base 58 a distance sufficient for slidably accepting the dovetail 52 of an adjacent unit 48. The notch 54 has a configuration which complements the configuration of the flared portion 64 of the dovetail 52. Accordingly, when two units 48 are slidably joined, the dovetail 52 of one is inserted, from the intake end 60, into the notch 54 of another. After the desired number of units 48 are joined, the reeds 18 are inserted into the slots 56, as described above, thereby completing the assembly 46.

While preferred embodiments of the present invention are shown and described, it is envisioned that those skilled in the art may devise various modifications of the present invention without departing from the spirit and scope of the appended claims. The invention is not intended to be limited by the foregoing disclosure, but only by the following appended claims.

What is claimed is:

1. A method of constructing a valve assembly locatable in a fluid flow path between an intake manifold and a cylinder in an internal combustion engine for preventing blow back from the cylinder into the manifold and for reducing back pressure in said manifold, the method comprising the steps of: molding a main body comprising an inlet and an outlet from a plastic material; insert molding a valve petal member in the main body for opening and closing the outlet; and further comprising the step of overmolding a cushioning surface onto the body adjacent the outlet against which the petal member engages and seals for closing said outlet.

2. A method of constructing a valve assembly locatable in a fluid flow path between an intake manifold and a cylinder in an internal combustion engine for preventing blow back from the cylinder into the manifold and for reducing back pressure in said manifold, the method comprising the steps of: molding a main body comprising an inlet and an outlet from a plastic material; insert molding a valve petal member in the main body for opening and closing the outlet; and further including the step of molding interlocking means onto the main body for interlocking a plurality of main bodies together wherein the interlocking means comprises a flared portion and a notch disposed on opposite portions of said main body; and the flared portion and the notch having complementary corresponding configurations so that a plurality of main bodies can be joined together by slidably inserting the flared portion of one body into the notch of another body.

3. A method according to claim 2 wherein a dove tail defines the flared portion; and a slot included on the dove tail for slidably accepting the petal member.

4. A valve assembly for location in an internal combustion engine in the fluid flow path between an intake manifold and a cylinder for preventing blow back and for reducing back pressure in said manifold, the valve assembly comprising: a molded thermoplastic valve unit having an inlet aperture means and an outlet aperture means; said inlet adapted to be operatively connected with the manifold, and the outlet adapted to be operatively connected with the cylinder; a reed valve petal member insert molded on said valve unit flexible between a valve open position where said member is offset from the outlet for permitting fluid flow from the manifold to the cylinder, and a valve closed position where said member operatively closes said outlet for preventing reversed fluid flow from the cylinder into the intake manifold, said reed valve member including aperture means through which thermoplastic material is disposed during insert molding which material bonds to the material of the valve unit to maintain said reed valve petal member in place.

5. A valve assembly as defined in claim 4, wherein said outlet aperture means defines a rim, and cushioning means overmolded onto at least a portion of said rim against which said reed valve petal member engages for closing said outlet.

6. A valve assembly as defined in claim 4 further comprising interlocking means disposed on the unit for interlocking a plurality of units together.

7. A valve assembly as defined in claim 4 wherein a plurality of said valve units are integrally molded together.

8. A valve assembly as defined in claim 7 wherein said valve units include a reed valve petal member support such that a support of one unit supports the reed valve petal member of an adjacent unit when said member is in the valve open position.

9. A method of constructing a valve assembly adapted for location in a fluid flow path between an intake manifold and a cylinder in an internal combustion engine of the general type for preventing blow back from the cylinder into said manifold and thereby reducing back pressure in said manifold, the method comprising the steps of: molding a main body comprising an inlet and an outlet from a plastic material; insert molding a valve petal member to said main body which valve petal member is adapted for opening and closing the outlet of said main body, said step of insert molding including the steps of; providing interlocking means in the valve petal member for accepting a molded plastic material, and overmolding a plastic material onto a portion of said valve petal member including said interlocking means for keying and flexibly attaching the valve petal member to the main body.

10. A method as defined in claim 9 wherein the valve petal member comprises a substantially planar reed flexible for closing the outlet.

11. A method as defined in claim 10 further comprising the step of forming a slot in the main body adjacent the outlet for slidably accepting a portion of the reed.

12. A method according to claim 9, wherein the step of providing interlocking means includes the step of providing apertures in said valve petal member.

13. A method according to claim 9, further comprising the step of overmolding a cushioning surface onto the main body adjacent said outlet and against which the petal member engages and seals for closing said outlet.

14. A method according to claim 9, further comprising the step of molding interlocking means onto the main body for interlocking a plurality of main bodies.

15. A valve assembly for location in an internal combustion engine in the fluid flow path between an intake manifold and a cylinder for preventing blow back and for reducing back pressure in said manifold, the valve assembly comprising: a molded thermoplastic valve unit having an inlet aperture means and an outlet aperture means; said inlet aperture means adapted to be operatively connected with the manifold, and the outlet aperture means adapted to be operatively connected with the cylinder; a reed valve petal member insert molded on said valve unit flexible between a valve open position where said member is offset from the outlet aperture means for permitting fluid flow from the manifold to the cylinder, and a valve closed position where said member operatively closes said outlet aperture means for preventing reverse fluid flow from the cylinder into the intake manifold, said reed valve member including interlocking means through which thermoplastic material is disposed during insert molding, which material serves to key and flexibly attach the valve petal member to the main body.

16. A valve assembly according to claim 15, wherein said interlocking means include aperture means formed in a portion of said reed valve petal member.

17. A valve assembly according to claim 15, wherein said molded thermoplastic valve unit includes a slot in a main body portion thereof adjacent the outlet for slidably accepting a portion of said reed valve petal member.

18. A method of constructing a valve assembly locatable in a fluid flow path between an intake manifold and a cylinder in an internal combustion engine for preventing blow back from the cylinder into the manifold and for reducing back pressure in said manifold, the method comprising the steps of: molding a main body having multiple chambers each having an inlet and an outlet from a plastic material; and insert molding a valve petal member into the main body in operative association with each of the chambers such that the valve petal member is flexible between an outlet closing position and an outlet opening position, and further comprising the cushion onto the rim such that the petal member engages the cushion when in the outlet closing position.

19. A method of constructing a valve assembly locatable in a fluid flow path between an intake manifold and a cylinder in an internal combustion engine for preventing blow back from the cylinder into the manifold and for reducing back pressure in said manifold, the method comprising the steps of: molding a main body having multiple chambers each having an inlet and an outlet from a plastic material; and insert molding a valve petal member into the main body in operative association with each of the chambers such that the valve petal member is flexible between an outlet closing position and an outlet opening position, and further comprising the steps of forming holes in the petal member for accepting an overmolded plastic; and overmolding plastic into the holes for keying the member to the body and for flexibly attaching the petal member to the main body.

* * * * *

UNITED STATES PATENT AND TRADEMARK OFFICE

CERTIFICATE OF CORRECTION

PATENT NO. : 5,253,617

DATED : October 19, 1993

INVENTOR(S) : Richard E. Fitzpatrick, William K. McDannel and Craig R. Leitner

It is certified that error appears in the above-indentified patent and that said Letters Patent is hereby corrected as shown below:

Column 10, Line 48 " the cushion " should read

— the steps of forming a rim adjacent each outlet; and overmolding a cushion —

Signed and Sealed this

Thirty-first Day of May, 1994

Bruce Lehman

*Attest:*

BRUCE LEHMAN

*Attesting Officer*

*Commissioner of Patents and Trademarks*